United States Patent [19]

Goltsos

[11] 3,985,992

[45] Oct. 12, 1976

[54] MICROWAVE HEATING TRAY

[75] Inventor: Costas E. Goltsos, Weston, Mass.

[73] Assignee: Teckton, Inc., Wellesley, Mass.

[22] Filed: July 17, 1974

[21] Appl. No.: 489,140

Related U.S. Application Data

[63] Continuation of Ser. No. 373,931, June 27, 1973, abandoned, which is a continuation-in-part of Ser. No. 167,185, July 29, 1971, abandoned.

[52] U.S. Cl. ..... 219/10.55 E; 426/243

[51] Int. Cl.[2] ..... H05B 9/06

[58] Field of Search ..... 219/10.55 E, 10.55 F; 126/390; 220/20, 22; 426/237, 243; 99/416, 448

[56] References Cited

UNITED STATES PATENTS

| | | | |
|---|---|---|---|
| 2,600,566 | 6/1952 | Moffett | 219/10.55 E |
| 2,714,070 | 7/1955 | Welch | 219/10.55 E |
| 3,219,460 | 11/1965 | Brown | 219/10.55 E |
| 3,230,864 | 1/1966 | Krajewski | 219/10.55 E |
| 3,271,169 | 9/1966 | Baker | 219/10.55 E |
| 3,271,552 | 9/1966 | Krajewski | 219/10.55 E |
| 3,302,632 | 2/1967 | Fichtner | 219/10.55 E |
| 3,547,661 | 12/1970 | Stevenson | 219/10.55 E |
| 3,667,452 | 6/1972 | Brebant et al. | 126/390 |

*Primary Examiner*—Bruce A. Reynolds
*Attorney, Agent, or Firm*—Wolf, Greenfield & Sacks

[57] ABSTRACT

Pre-frozen complete dinners are packaged in a compartmented tray which is formed from a material transparent to microwave radiation of a frequency which would be employed to heat or partially cook the food. The tray, with the various foods of the dinner in separate compartments, is taken directly from a freezer storage and is placed in a specially designed shielding box which in turn is placed in a microwave oven to heat the food. Means are provided on the box to control the degree to which each tray compartment, and the food contained therein, is exposed to the radiation, thus controlling the degree of heating or cooking of each of the foods independently of each other. Means are provided for isolating each of the compartments fully from each other while the food is being heated to preclude contact between the separate foods and gases generated during the heating or cooking process. The shielding box is intended to be used repeatedly as in mass feeding environments and is adapted to enable repetitive insertion and removal of food bearing trays. Each tray is of the same configuration and means are provided to insure proper orientation of the trays in the shielding box. Means also are provided for supplementally shielding a selected of the tray compartments from stray internally reflected radiation.

18 Claims, 12 Drawing Figures

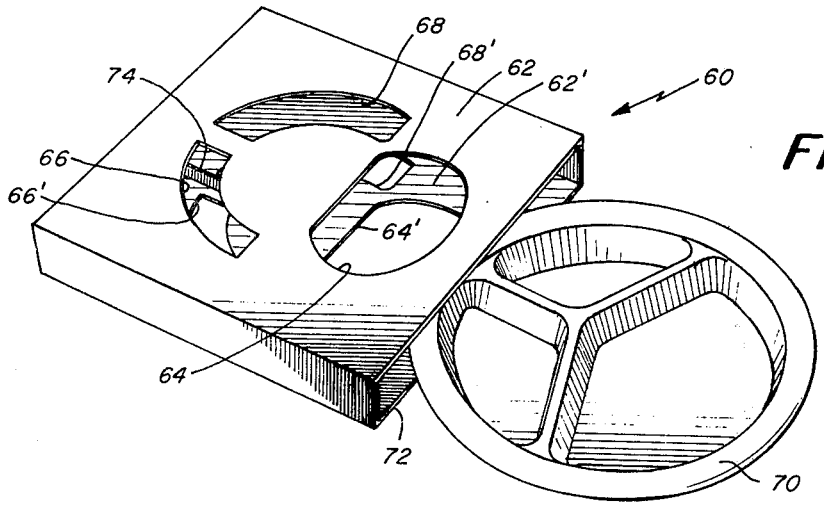
FIG. 7
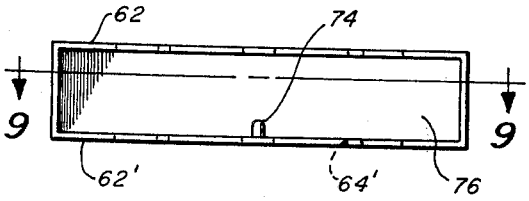
FIG. 8
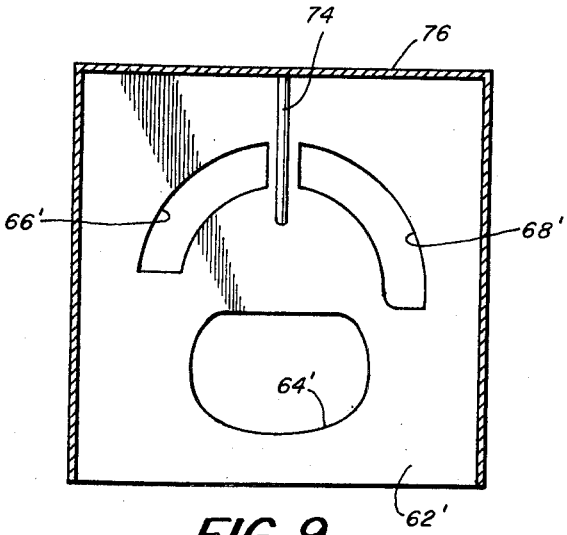
FIG. 9
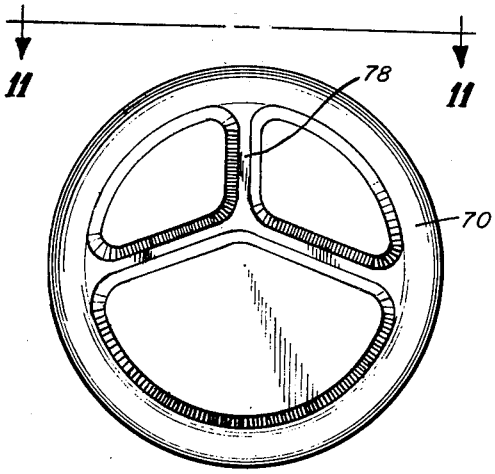
FIG. 10
FIG. 11
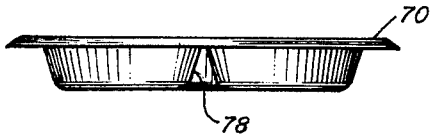
FIG. 12
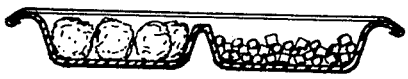

MICROWAVE HEATING TRAY

This application is a continuation of application Ser. No. 373,931, filed June 27, 1973, abandoned, which in turn, was a continuation-in-part of application Ser. No. 167,185, filed July 29, 1971, now abandoned.

BACKGROUND OF THE INVENTION

This invention relates to techniques for heating pre-frozen or refrigerated prepared meals by fast, microwave techniques. The invention is useful particularly when feeding large numbers of people as in institutional caferterias, hospitals, etc. The invention also is suited for use particularly when feeding a limited number of people with special foods such as persons having particular dietary requirements as might be found in a nursing home. Among the difficulties in preparing complete meals by microwave heating has been that because each of the foods require a different degree radiation exposure, it is difficult to control the exposure particularly when an entire meal composed of a plurality of different foods is to be heated simultaneously in the same oven.

One approach to this problem is suggested in U.S. Pat. No. 3,547,661 which describes an enclosure for the complete meal. That enclosure is opaque to the radiation except for radiation-transparent windows formed in the box in alignment with each food to expose the various foods to different degrees of radiation, depending on the size and shape of the windows. This technique has proved effective to heat the individual foods in an entire meal simultaneously to their properly cooked, serving temperature. However, because the specific arrangement there described is completely prepackaged with the food inside and is only usable once it may not be used with maximum economy when only a limited number of meals are to be served or where it is desirable to vary widely the different types of foods in the meals. For example, such variation might be desired where cafeteria menus change from day to day or, where special dietary requirements must be observed, such as in nursing homes, hospitals or the like. In the later instance it is often necessary to provide specially prepared combinations of foods for particular persons. This invention relates to an arrangement for enabling such variation of foods in a number of dinners while heating or cooking with microwave energy in an efficient and economical manner.

SUMMARY OF THE INVENTION

In accordance with the invention, the dinners are prepared and frozen in a radiation-transparent tray which is of inexpensive plastic molded construction. Ordinarily the foods in the dinner will be pre-cooked and then frozen or refrigerated in the tray. The foods preferably are slightly under-cooked so that when heated to proper serving temperature the added heat may complete the cooking process. Because the step of heating the pre-frozen dinner both heats the food to serving temperature and also partially cooks the food, this will be referred to herein as "heat conditioning". There are no regions on the tray which are opaque to the radiation. A number of such identical trays containing selected dinners formed from varieties of foods may be prepared and stored until ready for use. When a selected dinner is to be served, it is placed in a reusable control box which receives the tray and encloses the tray fully within. The walls of the box are provided with radiation-transparent apertures which are aligned with selected compartments of the tray and which permit microwave radiation to pass into the food in an amount permitted by the configuration of the apertures. The trays employed in the invention are formed to include food receiving compartments which, when the tray is retained in a predetermined orientation within the control box, are aligned with their associated apertures in the control box. After the food has been heat conditioned the box is opened and the tray with the food is removed. The control box is durable and is intended to be used repeatedly. In this regard, each of the trays used with a particular control box is of substantially identical configuration. Means are provided on the control box and the trays to insure proper placement and orientation of the tray in the box so that the radiation-transparent apertures will be in alignment with the proper tray compartments. Means are also included in the invention for isolating completely one compartment of the tray from any of the microwave energy so that this compartment may include ice-cream or other cold food even when in the oven and while the other goods in the dinner are being heat conditioned. Means also are provided for isolating each of the compartments in the tray from each other during heat conditioning so that no odors or gases, such as water vapor are passed from any of the foods to other foods in the tray.

It is among the primary objects of the invention to provide an improved device which enables complete dinners to be heat conditioned simultaneously by microwave energy and where all of the foods are brought to their proper cooking and serving temperatures within the same time.

Another object of the invention is to provide a device of the type described which may be employed to heat and serve specially prepared meals and which permits considerable variation in the combination of foods included in a particular meal.

A further object of the invention is to provide a device which isolates each of the foods from each other during heating.

Still another object of the invention is to provide a device for use in the microwave heating of food which is particularly suited for use in mass feeding environments or in feeding environments requiring special dietary considerations.

A further object of the invention is to provide a microwave heating device which may be used repeatedly with a plurality of substantially identical food bearing trays and in which means are provided for orienting the trays properly within the device.

DESCRIPTION OF THE DRAWINGS

The foregoing and other objects and advantages of the invention will be understood more fully from the following detailed description thereof, with reference to the accompanying drawings wherein:

FIG. 7 is an illustration of a modified form of a control box shown receiving a circular tray;

FIG. 8 is an illustration of the control box shown in FIG. 7 as seen from the open side thereof;

FIG. 9 is a sectional illustration of the control box shown in FIG. 8 as seen along the line 9—9 of FIG. 8;

FIG. 10 is an illustration of the underside of the tray shown in FIG. 7;

FIG. 11 is an edge view of the tray shown in FIG. 10 as seen along the line 11—11 of FIG. 10; and FIG. 12 is a side elevation, in section, of a tray having a plastic radiation-transparent film covering its compartments and heat sealed to the tray to isolate the compartments.

DESCRIPTION OF THE PREFERRED EMBODIMENT

Figure 1:
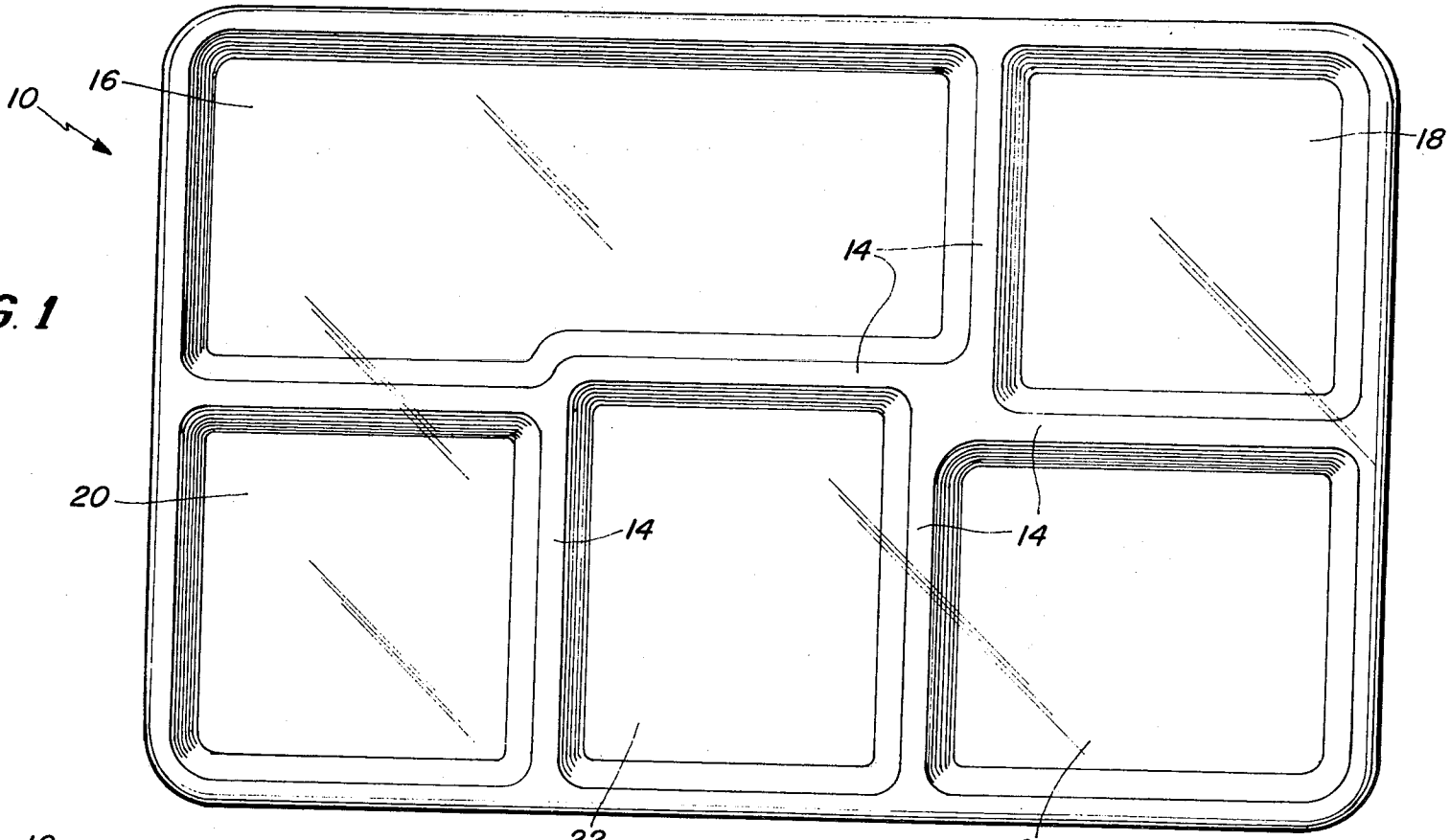
FIG. 1 is a plan view of a typical tray in which the food is kept.
Figure 2:
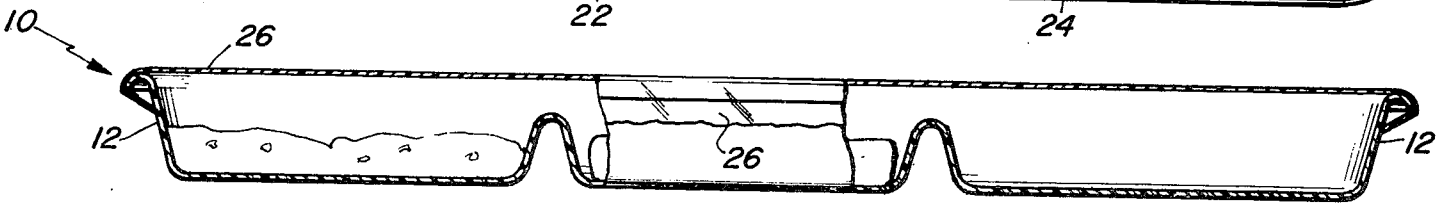
FIG. 2 is a side elevation, partly broken away, of the tray shown in FIG. 1.

FIGS. 1 and 2 show one enbodiment of the invention including the food carrying tray which is formed from a material transparent to electromagnetic radiation, particularly microwave energy. Preferably the tray 10 is formed from an easily moldable inexpensive plastic such as styrene or the like. The tray 10 includes a bottom wall, surrounding wall 12 and a number of interior upstanding ridges 14. The wall 12 and ridges 14 are arranged to define a plurality of compartments 16, 18, 20, 22 and 24 which are intended to hold different foods such as, for example, meat, vegetables, potatoes, rolls and ice-cream, respectively. In the preferred embodiment, the wall 12 extends upwardly beyond the height of the ridges. The wall 12 and ridges 14 also tend to strengthen the tray.

The trays are filled with the desired foods comprising a complete meal and are frozen directly in the tray for subsequent use. The tray is covered with an appropriate protective cover which is effective to seal the food within the tray. The cover 26 preferably is in the form of a radiation-transparent film and, if desired, may be optically transparent. The frozen prepackaged dinner may be stored in the tray for considerable time periods until use. The food thus is prepackaged and sealed for an indefinite time period in a tray of simple, inexpensive construction and which is easy to use.

The foods placed in the tray may be selected to suit the particular feeding requirements. For example, when used to serve persons having special dietary requirements a number of prepared dinners matching those requirements may be prepared in advance for storage and subsequent use. Similarly, when special dietary requirements are not a consideration a number of various meal combinations may be prepared to provide a variety of meal selections. Preferably, each of the meals is arranged in a predetermined pattern in the tray in which certain kinds of foods are disposed in certain of the compartments for reasons which will be apparent below.

In order to heat the complete meal simultaneously so that all the foods are heat conditioned properly and are brought to the proper serving temperature it is essential to control the radiation to which the different foods in each dinner are exposed. For example, meat requires more exposure to the microwave energy than do rolls in order to reach proper serving temperature. Ice-cream must be shielded completely from the microwave energy so that it may be served at the proper cold temperature.

Figure 3:
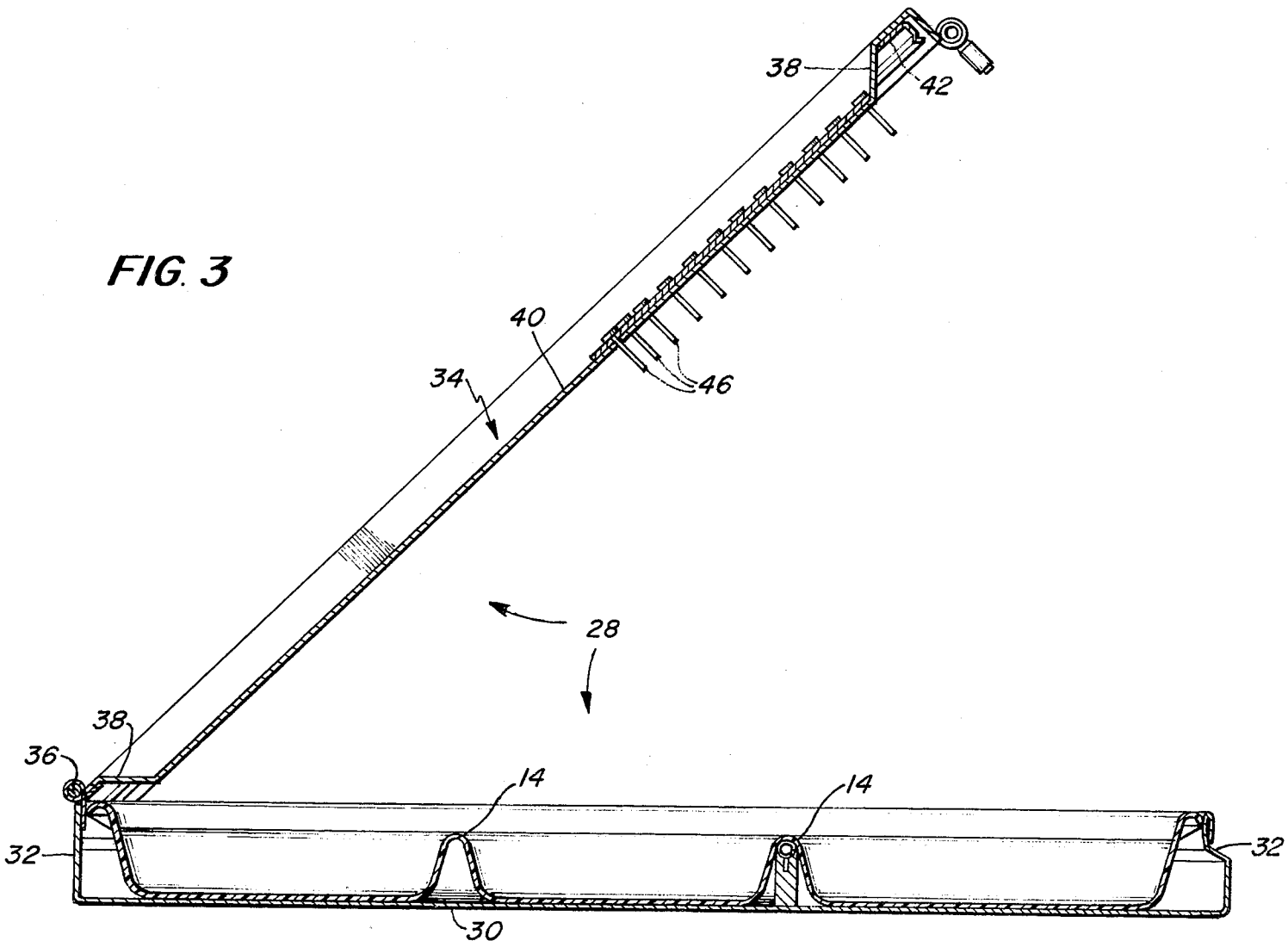
FIG. 3 is a side elevation, in section of the shielding control box with its cover raised.

In order to control the exposure of the different foods in each meal to the proper amount of microwave energy, the invention employs a shielding control box 28 shown in FIG. 3. The control box 28 may be of metallic or equivalent construction and is opaque to the microwave energy. The box 28 includes a bottom wall 30 and peripheral side wall 32 in which the tray 10 is received. Preferably, the tray and box are designed so that the tray fits snugly within the box and there is no shifting about of the tray within the box. The control box 28 also includes a lid 34 which is hinged, at 36, to the rear edge of the side wall 32. In the preferred embodiment shown, the lid 34 includes a peripheral rim which defines a depressed main central portion 40. As shown, in FIG. 5, when the lid of the cooking box is closed, the central depressed portion 40 of the lid bears firmly against the ridges 14 while the rim 38 bears firmly and downwardly against the upper edge of the side wall 32. This configuration is effective to press the cover film 26 downwardly against the inner ridges 14 of the tray to isolate each of the compartments and preclude cooking odors from being transferred between compartments. Other configurations may be employed for the lid 34 and tray. For example, the ridges 14 could be of the same height as the side wall 32. In this instance the lid 34 could be flat as to press the cover film 26 firmly against the walls and ridges of the tray 10.

Figure 4:
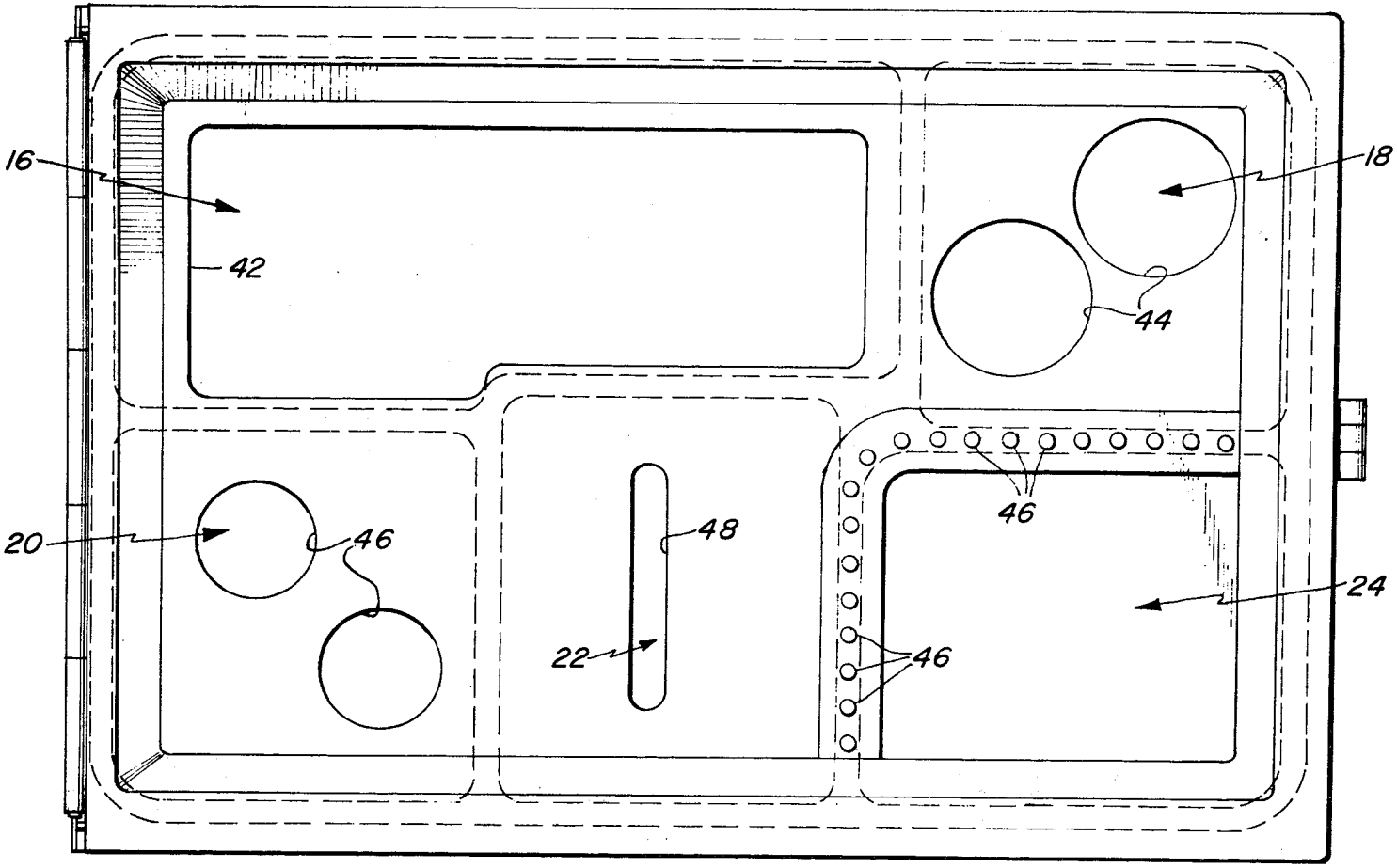
FIG. 4 is a plan view of the control box and tray when combined.
Figure 6:
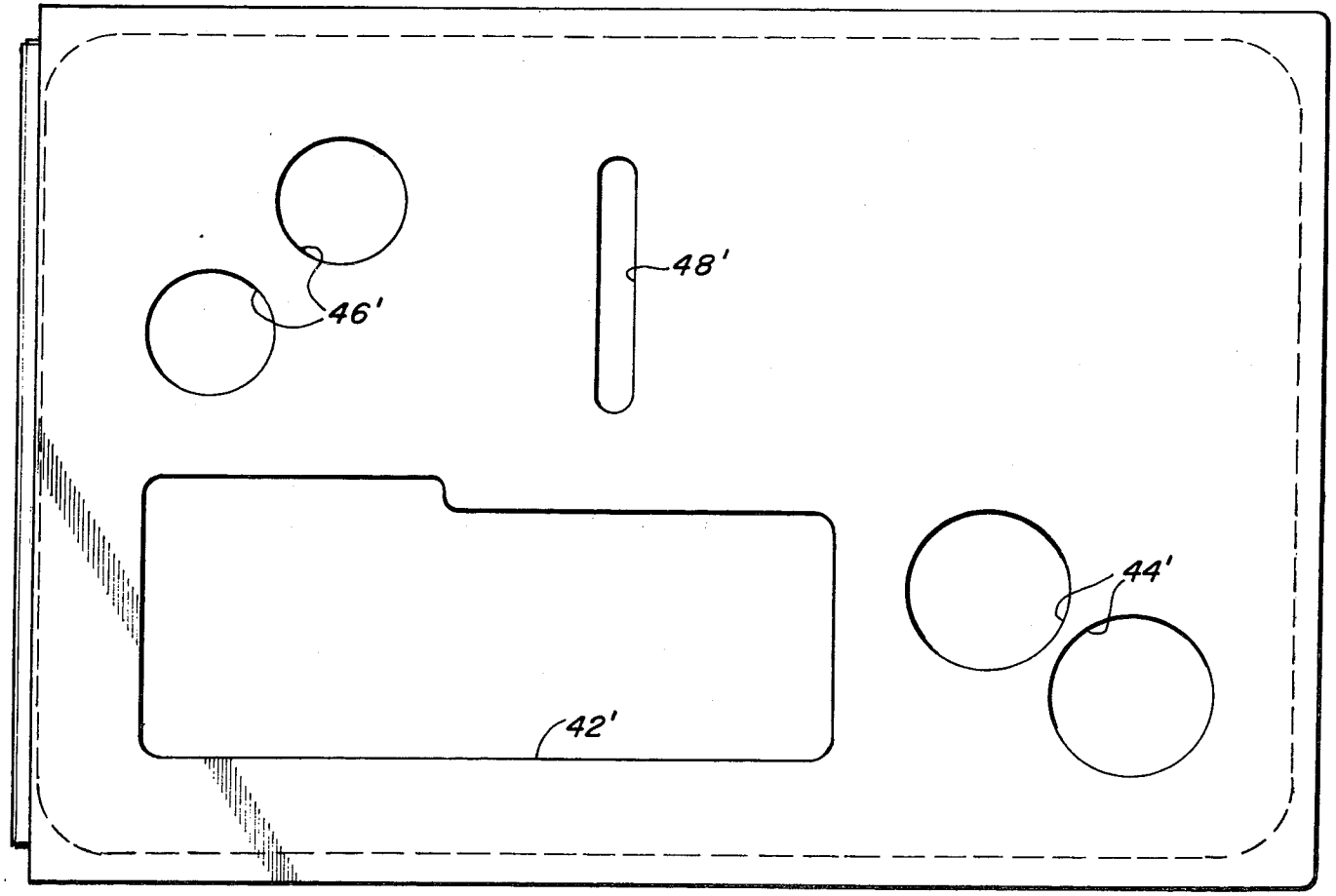
FIG. 6 is a bottom view of the control box.

The degree of radiation to which each of the foods in the respective compartments is exposed is controlled by forming appropriate apertures in the lid 34 and bottom wall 30 of the cooking box 28. As shown in FIGS. 4 and 6, the lid 34 formed with a plurality of apertures and the bottom wall 30 similarly includes an array of substantially identical apertures which, when the box is closed, are in registry with the apertures in the lid. The registered apertures are aligned with the compartments in the tray when the tray is placed in the control box. The size and configuration of the apertures aligned with their associated tray compartments control the amount of radiation which is transmitted to the food in those compartments. For example, meat which would be in compartment 16 would be substantially fully exposed to the radiation through the relatively large apertures 42, 42′. Similarly, the vegetables in the compartments 18 would be exposed in a controlled amount through the apertures 44, 44′. Potatoes in the compartment 20 would be exposed through the aligned apertures 48, 48′. In the illustrative embodiment, the compartment 24 is intended to contain ice-cream which obviously must be served cold and is not exposed to any radiation. Thus, the regions of the bottom wall 30 of the control box 28 and the lid 34 which are aligned with the tray compartment 24 have no apertures and will reflect all the microwave energy directed toward the tray. By exposing the pre-frozen dinner in the tray through the cooking box apertures the dinner can be completely cooked with all of the foods being cooked properly and at the proper serving temperature when the meal is done. Moreover, because the aligned apertures are adapted to pass equal amounts of radiation, scattered radiation within the box is minimized and heating is controlled more effectively.

Means are provided for insuring that the tray will be placed in the control box in predetermined proper orientation in which the apertures are aligned with the proper tray compartments so that the types of foods in the compartments will be exposed to the proper amount of microwave energy. To this end, the control box includes the inner wall member 48 which is secured to and extends upwardly from the bottom wall of the cooking box 30. The inner wall 48 is arranged to be received beneath the ridge 14 which defines the ice-cream compartment 24 as shown in the illustrative embodiment. The ridge 14 defining the compartment 24 is asymmetrical with respect to the tray and the other ridges which insures that it can only be properly placed in the control box in the desired predetermined orientation with respect to the apertures in the box. Other arrangements as described more fully herein may be employed to insure proper orientation of the tray within the control box.

The control box preferably also includes a latch at its front end to hold the tray and box elements firmly together during cooking. Additionally, means are provided for insuring electrical contact between the control box lid 34 and the tray retaining portion of the box to preclude arcing. This may be achieved by providing a metallic spring 42 about the inner edge of the lid which engages in firm electrical contact the side wall 32 of the box. Additionally, electrical contact may be established between the lid and box by a pin and socket arrangement 44 which also serves other functions as described below.

Figure 5:
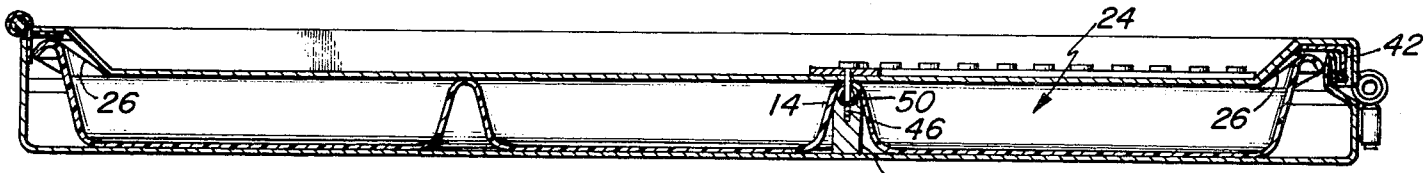
FIG. 5 is an elevation, in section, of the combined control box and tray shown in FIG. 4.

When ice-cream or other frozen food is an element of the meal, it is important to shield it effectively from the microwave radiation. Although the use of aligned apertures, adapted to pass equal amounts of radiation, is effective to minimize substantially microwave radiation reflected within the cooking box, there may be instances where a certain amount of the radiation might be reflected along a non-vertical directed, within the cooking box, toward the ice-cream compartment. This could soften some portions of the ice-cream which is undesirable. In order to effectively preclude any reasonable possibility of this occurence, the compartment 24 in which the ice-cream is kept, also may be shielded from non-vertical reflected radiation by means of a plurality of vertically disposed pins 46 which extend around the compartment 24 when the cooking box is closed. As shown in FIGS. 3, 4 and 5 the pins 46 may be secured to the lid. The size and spacing of the pins is dependent on the characteristics of the microwave radiation and is effective to block any horizontally reflected radiation. For example, when using microwave energy of the order of 2450 MHz the pins preferably are spaced approximately three-eighths of an inch from each other. The pins 46 also are employed to establish an additional electrical connection between the box and the lid to preclude arcing. This arrangement includes the inner wall 48 described above with regard to orienting the tray in the control box. The inner wall 48 is dimensioned to be received beneath the ridge 14 which defines the ice-cream compartment 24. Extending along the upper edge of the inner wall 48 is a slot in which a helical spring 50 is received, the spring extending fully along the wall. When the box is closed, the pins pierce the ridge 14, extend downwardly through the slot and engage the helical spring to establish firmly the electrical contact between all portions of the cooking box. This also locks the tray further in the proper place.

With the foregoing arrangement, having a generally standardized tray configuration, numerous foods may be varied to form different meal combinations. It is important that when preparing the frozen foods in the tray they are placed in the proper compartment so that when they are cooked in the cooking box they will be exposed properly to the radiation required to cook them. Thus, for most meals, only one type of cooking box will be necessary. In some instances, however, where ice-cream is not part of the meal, other cooking boxes having other aperture configurations may be employed. Generally, there will be little need to employ different types of control boxes and it is necessary only to employ a relatively small number of boxes, because they may be used repeatedly.

FIGS. 7–11 show another embodiment of the invention in which an open-ended control box 60 is provided having upper and lower parallel walls 62, 62′. As in the previously described embodiment, the upper and lower walls 62, 62′ are formed to define aligned radiation-transparent windows 64, 64′, 66, 66′ and 68, 68′, the respectively aligned apertures being adapted to pass substantially equal amounts of radiation therethrough. The tray 70 shown in this embodiment is circular and may be inserted and removed from an opening 72 in the side of the control box 60 to position the tray compartments, and food therein, properly with respect to the radiation-transparent windows. As described above with regard to the previous embodiment, it is important to insure that when the tray 70 is placed in the control box, its compartments will be aligned in proper orientation with respect to the apertures in the control box so that the particular foods in the respective tray compartments will each be exposed to the intended and controlled degree of radiation. In this embodiment, the tray orientation arrangement may include an elongate key 74 mounted to the bottom wall 62′ of the control box 60 and extending from the rear wall 76 of the box 60 forwardly. The elongate key 74 extends upwardly from the bottom wall 62′ and is dimensioned in relation to the tray 70 so that when the tray is inserted into the control box 60 through the opening 72, it can only be inserted fully when the key 74 is in alignment with the raised underside 78 of a ridge 80 defining one of the compartments of the tray 70. In this embodiment, where the tray 70 is of circular configuration, the ridge 80 extends generally radially of the tray. The other ridges 82 of the tray 70 do not extend radially of the tray and the complete array of ridges are arranged asymmetrically. Thus, with this configuration, the tray 70 is precluded from being fully inserted into the control box 60 in readiness to be cooked, unless the underside 78 of the ridge 80 is in longitudinal alignment with the key 74. The extent to which the tray may be inserted into the control box may be controlled by engagement of the inner most edge of the tray 70 with the rear wall 76 of the box or, if desired, engagement of the forwardly protruding end of the key 74 with the inner most end of the underside of the ridge 80.

The first described embodiment of the invention referred to a modification in which the food bearing tray was covered with a radiation-transparent, anad preferable optically-transparent, plastic film. In those instances where the control box is of a configuration other than the hinged lid arrangement of the first described embodiment herein, the plastic film still may be employed to isolate each of the food compartments from the other to preclude migration of water vapor or food odors from one compartment to the other. As shown in FIG. 12, this may take the form of a heat sealable plastic film 90 which is disposed over the top of the food tray 92 and in which the plastic film is heat sealed to the upper edge of each of the ridges 94 as well as to the upper edge of the peripheral side wall 96 of the tray. This arrangement could be employed, for example, with the control box shown in FIGS. 7–9. With the arrangement shown in FIG. 12, it is preferred that the ridges and side walls be of substantially the same height, although this is not strictly required and if other considerations indicate a preference for a tray having ridges of lesser height, the plastic film may still be affixed to the upper surfaces of the tray side wall and ridges.

It should be understood that the foregoing description of the invention is intended merely to be illustrative thereof and that other embodiments and modifications may be apparent to those skilled in the art without departing from its spirit.

Having thus described the invention what I desire to claim and secure by Letters Patent is:

1. An apparatus for heat conditioning a meal with microwave energy comprising, in combination:

a tray formed from a material which is transparent to said energy;

means defining a plurality of compartments in said tray for retaining a plurality of different foods in predetermined relative locations on said tray;

a control box having a pair of opposite walls and formed from a material which is opaque to said microwave energy, said control box being receptive to said tray between said walls;

means forming at least one aperture in each of said opposite walls of said control box, said apertures in said opposite walls being in registry with each other and with one of said tray compartments when said tray is contained in a predetermined orientation within the box, said apertures in said opposite walls being aligned with each other and being adapted to pass said microwave energy in substantially equal amounts therethrough;

said control box being constructed to provide access to the interior thereof to enable a plurality of said trays to be sequentially inserted into and removed from said control box one at a time; and said control box and said tray including interfering means cooperative to substantially preclude insertion of said tray into said control box when said tray is in other than said predetermined orientation.

2. An apparatus as defined in claim 1 further comprising:

said control box being constructed to substantially surround and enclose said tray and further comprising:

means for reclosably opening said box to enable removal or insertion of said tray and to enable said box to be reclosed whereby said box may be used repetitively with a succession of said food bearing trays.

3. An apparatus as defined in claim 1 wherein said means for reclosably opening said control box comprises:

means mounting one of said apertured walls for movement relative to the remaining portions of said box between an open and closed configuration.

4. An apparatus as defined in claim 1 wherein said apertures are formed in said opposite walls of said box so that all but one of said compartments in said trays are exposed to said radiation.

5. An apparatus as defined in claim 4 further comprising:

means mounted to said control box interiorly of said box for shielding said one compartment from electromagnetic radiation reflected internally of said control box.

6. An apparatus as defined in claim 5 wherein said internal shielding means comprises:

a plurality of pins mounted to one of said apertured walls of said control box and extending therefrom generally toward the other of said apertured walls, said pins being arranged in a pattern adapted to surround at least selected portions of said one compartment, said pins being dimensioned and spaced from each other to preclude admission of horizontally directed components of said energy into said one compartment.

7. An apparatus as defined in claim 6 further comprising:

at least said one compartment of said tray being defined by an upwardly extending ridge, said pins being mounted to said box so that when said tray is oriented in said box in said predetermined orientation said pins may pass through said ridge.

8. An apparatus as defined in claim 1 further comprising:

said control box having an opening in the side thereof to receive said tray along a direction parallel to and between said opposite walls.

9. An apparatus as defined in claim 1 further comprising:

said tray having a surface formed thereon which is asymmetrically disposed thereon:

a member formed on said control box and engagable with said asymmetrically formed surface of said tray to preclude full insertion of said tray into said box except when said asymmetrical surface is in alignment with said member.

10. An apparatus as defined in claim 1 further comprising:

said tray and compartments thereof being defined by an upstanding wall extending about the periphery of said tray and at least one ridge extending upwardly from the bottom of the tray, the underside of at least a portion of said at least one ridge being disposed out of the plane of the bottom wall of said tray;

means formed on one of said apertured walls for engaging the underside of at least a portion of said at least one ridge, said at least one ridge and said ridge engaging means on said control box being constructed and arranged to be engagable with each other only when said tray is in said predetermined orientation.

11. An apparatus as defined in claim 10 further comprising:

said ridges and compartments defined thereby being arranged asymmetrically on said tray.

12. An apparatus as defined in claim 10 further comprising:

said ridge engaging means comprising a member mounted to the lower of said apertured walls, said member being constructed and arranged to extend upwardly into one of said tray ridges to extend around a selected compartment defined by said ridge;

a plurality of pins mounted to the other of said apertured walls, said pins being disposed over and in alignment with said member, said pins being dimensioned and spaced from each other to preclude admission of horizontally directed components of said energy into said compartment, said pins being constructed and arranged to pass through said ridge and to be electrically connected to said member;

said ridge being disposed asymmetrically on said tray; and said opposite walls having no apertures in alignment with said selected tray compartment.

13. An apparatus as defined in claim 1 further comprising:

said tray being defined by a bottom wall, an upstanding peripheral wall and at least one ridge extending upwardly from said botton wall;

a radiation-transparent flexible film covering said tray and being secured thereto about said peripheral upstanding wall;

means constructing said control box so that when said tray is disposed therein in said predetermined orientation and in readiness to be exposed to said microwave energy, said radiation-transparent film will be pressed firmly against the upper edge of said ridges to isolate each of said food bearing compartments.

14. An apparatus as defined in claim 13 further comprising:

said ridges being of a height which is less than that of said peripheral wall.

15. An apparatus as defined in claim 14 further comprising:

said control box including a first section having a bottom wall which comprises one of said apertured walls, said bottom wall being surrounded by an upstanding sidewall;

said control box further including a lid hinged to said sidewall, said lid comprising the other of said apertured walls, said lid being shaped with respect to the relative height of the peripheral of the sidewall of said tray and said ridges of said tray to press said radiation-transparent film firmly against said ridges when said lid is closed.

16. A tray adapted to contain various foods of a complete meal comprising:

a bottom wall and a sidewall surrounding said bottom wall and extending upwardly therefrom;

said bottom wall being formed to define at least one upwardly extending ridge within said tray to define a plurality of tray compartments, said walls and ridges being formed from a material transparent to energy of a character adapted to heat condition foods;

a film transparent to said radiation and extending over said tray and being connected to said tray at least along the upper surface of said sidewall;

said ridges being of a height which is less than that of said sidewall, said film being sufficiently flexible to enable it to be pressed downwardly into said tray and against the upper surfaces of said at least one ridge thereby to isolate each of said tray compartments from each other when desired.

17. A tray as defined in claim 16 wherein said film is also optically transparent.

18. An apparatus for heat conditioning a meal with microwave energy comprising, in combination;

a tray formed from a material which is transparent to said energy;

means defining a plurality of compartments in said tray for maintaining a plurality of different foods in predetermined relative locations on said tray;

a control box having a pair of opposite walls and formed from a material which is opaque to said energy, said control box being receptive to said tray between said walls to enable said tray to be removably inserted between said walls;

aperture means transparent to said energy and formed in at least one of said walls of said control box at a predetermined location and of predetermined configuration with respect to selected of said compartments of said tray when said tray is disposed within said control box;

said control box being constructed to provide access to the interior thereof to enable a plurality of said trays to be sequentially inserted into and removed from said control box; and said control box and said tray each including cooperative means to enable insertion and placement of said tray within said control box in a selected relative position in which said aperture means is in alignment with a selected tray compartment.

* * * * *